US005172025A

United States Patent [19]

Oshima et al.

[11] Patent Number: 5,172,025

[45] Date of Patent: Dec. 15, 1992

[54] GLASS SEALANT OF SPARK PLUG INSULATOR FOR USE IN AN INTERNAL COMBUSTION ENGINE

[75] Inventors: Takafumi Oshima; Hiroyasu Ogura, both of Nagoya, Japan

[73] Assignee: NGK Spark Plug Co., Ltd., Nagoya, Japan

[21] Appl. No.: 786,020

[22] Filed: Oct. 31, 1991

[30] Foreign Application Priority Data

Oct. 31, 1990 [JP] Japan ..... 2-292117

[51] Int. Cl.[5] ..... H01T 13/20

[52] U.S. Cl. ..... 313/136; 313/11.5

[58] Field of Search ..... 313/136, 11.5

[56] References Cited

U.S. PATENT DOCUMENTS 2,106,578 1/1938 Swartzwalder ..... 313/136 X 2,837,679 6/1958 Schwartzwalder et al. ... 313/11.5 X 3,247,132 4/1966 Schurecht et al. ..... 313/136 X

*Primary Examiner*—Palmer C. DeMeo

*Attorney, Agent, or Firm*—Cooper & Dunham

[57] ABSTRACT

In a spark plug insulator, an electrically conductive sealant in provided to connect a center electrode to a terminal electrode which are provided within an axial bore of the tubular insulator. The glass sealant being made from the following materials: (a) granular aluminosilicate glass consisting of silica ($SiO_2$), alumina ($Al_2O_3$), alkali metal oxides and alkali earth metal oxides, granular size of the aluminosilicate glass being more than 250μ; (b) granular silicate glass, granular size of which is less than 74μ; and (c) powdered metal, granular size of which is less than 74μ, and selected from the group of nickel, chromium and nickel-chromium alloy.

5 Claims, 6 Drawing Sheets interface (Ia) between center electrode and terminal electrode (x300)

Pt (x300)

Ni (x300)

(glass-based components)

Al (x300)

Si

O (x300)

GLASS SEALANT OF SPARK PLUG INSULATOR FOR USE IN AN INTERNAL COMBUSTION ENGINE

BACKGROUND OF THE INVENTION

1. Field of the Invention

This invention relates to a glass sealant provided within a spark plug insulator to connect a center electrode to a terminal electrode which are provided within an axial bore of the tubular insulator, and the invention particularly concerns to a composition of the glass sealant to impart heat-resistant property to the glass sealant.

2. Description of Prior Art

In a spark plug for use in an internal combustion engine, an electrically conductive glass sealant is airtightly provided within a tubular insulator of the spark plug to electrically connect a center electrode to a terminal electrode which are provided within an axial bore of the tubular insulator.

The glass sealant has generally been mainly made of borosilicate glass ($SiO_2$—$B_2O_3$—$Na_2O$) and filler metals.

Since the borosilicate glass has a softening point of 600°~700° C., it begins to soften when the engine is operated at 5000 rpm with full throttle. This is because a front end of the insulator is exposed to a combustion chamber of the engine so that temperature of the front end rises as far as 1000° C.

The borosilicate glass thus softened causes to reduce its viscosity so as to induce voids, and isolating glass components from metal components to significantly deteriorate its electrical conductivity.

On the other hand, the filler metal is made of boron, copper, tin and the like so as to improve tightness against the terminal electrode which is made of steel. The additive of boron, copper and tin reacts to precious metals of the center electrode to compose metal compound of low-melting point, thus corroding the precious metals too badly to insure the electrical conductivity between the center electrode and the terminal electrode.

Therefore, it is an object of the invention to obviate the above disadvantages, and providing a glass sealant composition which is capable of positively maintaining electrical conductivity between a center electrode and a terminal electrode when exposed to high temperature environment.

SUMMARY OF THE INVENTION

According to the invention, there is provided a spark plug comprising: a metallic shell in which a tubular ceramic insulator is placed; a center electrode which is made of precious metals, and is supported at a front open end of the insulator simultaneously when the ceramic insulator is sintered, a front end of the center electrode opposing an outer electrode extended from the metallic shell to form a spark gap therebetween; an electrically conductive glass sealant placed within the insulator to electrically connect the center electrode to a terminal electrode which is provided in rear open end of the insulator; the glass sealant being made from the following materials: (a) granular aluminosilicate glass consisting of silica ($SiO_2$), alumina ($Al_2O_3$), alkali metal oxides and alkali earth metal oxides, granular size of the aluminosilicate glass being less than 250 μ; (b) granular silicate glass, granular size of which is less than 74 μ; and (c) powdered metal, granular size of which is less than 74 μ, and selected from the group consisting of nickel, chromium and nickel-chromium alloy.

According to further invention, a relationship of weight ratio between (a), (b) and (c) is determined as follows: $0.8 \leqq [(a)+(b)]/(c) \leqq 1.2$ and $0.05 \leqq (b)/[(a)+(b)] \leqq 0.2$.

Furthermore, weight percentage of the granular aluminosilicate glass ranges from 40% to 50%, weight percentage of the granular silicate glass ranging from 2.5% to 10%, weight percentage of the powdered metal ranging from 40% to 60%.

Stillfurther, softening point of both the aluminosilicate glass and the silicate glass is more than 1000° C.

Addition of the granular aluminosilicate glass leads to improving softening point of the glass sealant, while the granular size of less than 250μ prevents the glass sealant from shrinking after heating the glass sealant within the insulator.

With the granular size of the silicate glass in less than 74μ, and with the powdered metal selected from the group consisting of nickel, chromium and nickel-chromium alloy, reactivity between the granular silicate glass and the powdered metal is improved so that the reactivity of the powdered metals against the precious metal is limited so as to reduce the metal compound of low-melting point.

By the substantially constant ratio of the glass-based component to the metal-based component, it is possible to positively vitrify the glass sealant at an operating temperature, and decreasing the difference of thermal expansion between the glass sealant and the insulator so as to protect the insulator against cracks, and further contributing to maintaining good electrical conductivity between the center electrode and the terminal electrode.

These and other objects and advantages of the invention will be apparent upon reference to the following specification, attendant claims and drawings.

DETAILED DESCRIPTION OF THE EMBODIMENTS

Figure 1:
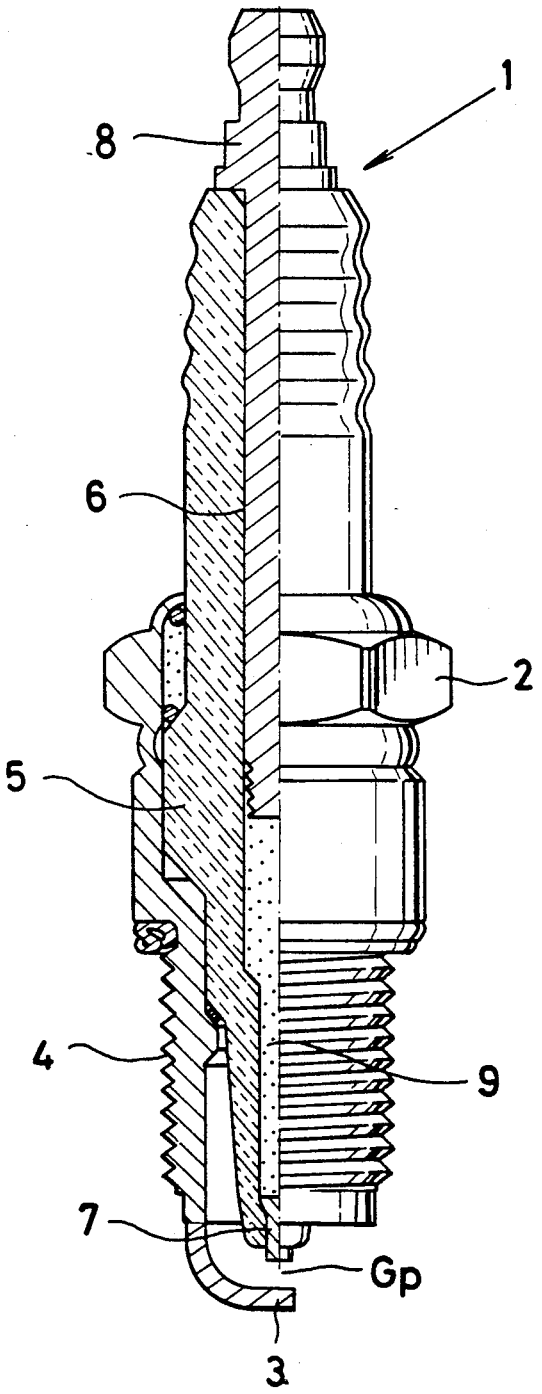
FIG. 1 is a longitudinal cross sectional view of a spark plug according to an embodiment of the invention, but right half of the spark plug is not sectioned.

Referring to FIG. 1 which shows a spark plug for use in an internal combustion engine, the spark plug 1 has a metallic shell 2 whose outer surface has a male thread portion 4 used when the spark plug 1 is mounted on a cylinder head of the engine. Within the metallic shell 2, a tubular insulator 5 is concentrically placed which is made with alumina ($Al_2O_3$) as a main component. An inner space of the tubular insulator 5 serves as an axial bore 6 whose front open end supports a center electrode 7 which is made of precious metal such as e.g. Pt-Ir alloy simultaneously when the insulator 5 is sintered at 1600° C. in the atmosphere. Otherwise, the center electrode 7 may be made of an alloy in which yttrium oxide ($Y_2O_3$), zirconium oxide ($ZrO_2$) and thorium oxide ($ThO_2$) are uniformly dispersed in Platinum (Pt). A front end of the center electrode 7 opposes an outer electrode 3 extended from the metallic shell 2 so as to form a spark gap (Gp) between the center electrode 7 and the outer electrode 3.

Figure 2:
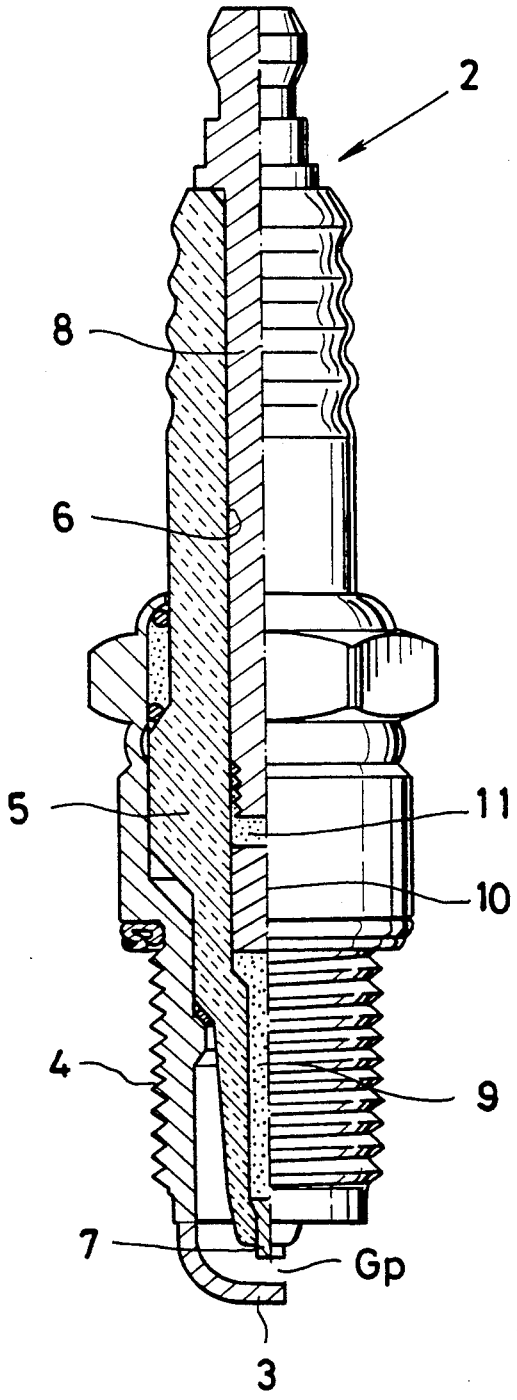
FIG. 2 is a view similar to FIG. 1 according to a modification form of the invention.
Figure 3:
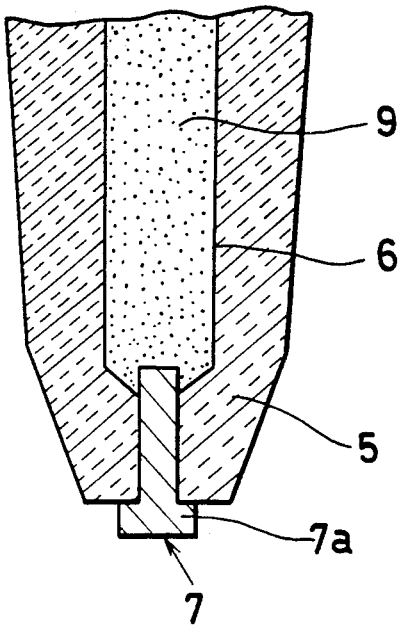
FIG. 3 is a longitudinal cross sectional view of a main part of the spark plug according to other modification form of the invention.

On the other hand, a rear open end of the insulator 5 receives a terminal electrode 8 which aligns with the center electrode 7 within the axial bore 6. An electrically conductive glass sealant 9 is air-tightly placed within the insulator 5 by heating the glass sealant 9 to electrically connect between the center electrode 7 and the terminal electrode 8. The glass sealant may be formed into 12 glass press blocks, and the press blocks may be pressed by the pressure of 60 Kg/cm$^2$. After completing the procedure, the glass press blocks may be sealed with an electrically conductive packing 11 and resistor 10 as shown in FIG. 2. A front end of the center electrode 7 may be diametrically increased to form an enlarged head 7*a* as shown in FIG. 3.

The glass sealant 9 is made from the following materials:

(a) Granular aluminosilicate glass consisting of silica ($SiO_2$), alumina ($Al_2O_3$), alkali metal oxides and alkali earth metal oxides, granular size of the aluminosilicate glass being less than 250μ;

(b) Granular silicate glass, granular size of which is less than 74μ; and (c) Powdered metal, granular size of which is less than 74μ, and selected from the group consisting of nickel, chromium and nickel-chromium alloy.

Addition of the granular aluminosilicate glass leads to improving softening point (usually 850°~950° C.) of the glass sealant 9.

Figure 4:
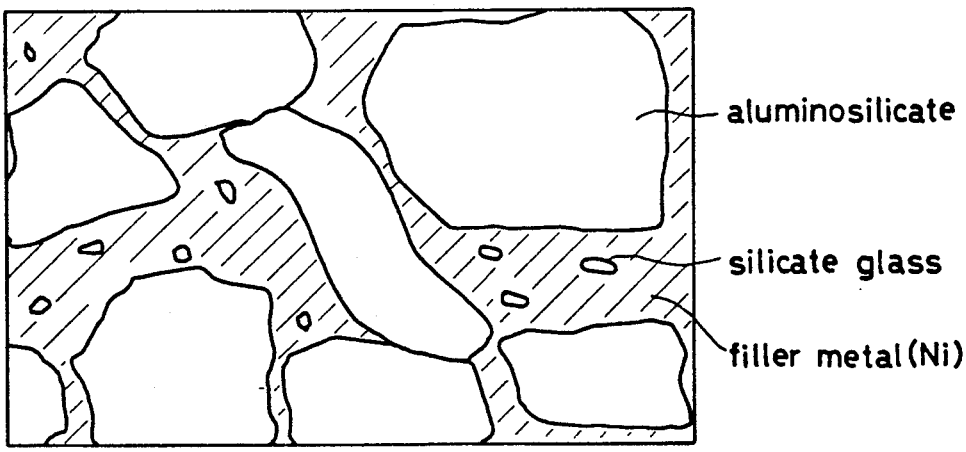
FIG. 4 shows a structure of a glass sealant having a high softening point.

Further, the silicate glass reacts to the aluminosilicate glass at the time of heating the glass sealant 9 within the insulator 5, and thus forming a vitrified substance having a high softening point (more than 1000° C.). Part of the aluminosilicate glass remains in the powdered metal (filler metal), the remaining part of the aluminosilicate glass does not affect on electrical conductivity of the glass sealant 9 as understood from FIG. 4.

The granular size of the aluminosilicate glass requires less than 250μ (preferably less than 105μ: less than 30 weight %, less than 149μ: less than 50 weight % and less than 250μ: more than 98 weight %) to prevent the glass sealant 9 from shrinking after heating the glass sealant 9 within the insulator 5.

The granular size of the silicate glass requires less than 74μ (preferably less than 44μ) to facilitate the reactivity between the silicate glass and the aluminosilicate glass.

As a powdered metal, oxidation-resistant metal such as nickel, chromium or nickel-chromium alloy is required to limit the powdered metal from chemically reacting to the precious metal of center electrode 7, thus limiting formation of metal compound which has a low-melting point.

A relationship of weight ratio between (a), (b) and (c) is determined as follows:

$$0.8 \leqq [(a)+(b)]/(c) \leqq 1.2 \text{ and}$$
$$0.05 \leqq (b)/[(a)+(b)] \leqq 0.2.$$

The weight ratio of glass-based component to metal-based component is restricted within a range from 0.8 to 1.2 (preferably 1.0). An excessive amount of the metal-based component increases a thermal expansion coefficient of the glass sealant 9, thus leading to cracks on the insulator 5 at the time of heating the glass sealant 9 within the insulator 5. Too little amount of the metal-based component makes it difficult to sufficiently ensure electrical conductivity between the center electrode 7 and the terminal electrode 8.

The weight ratio of the silicate glass to the vitric component is restricted within a range from 0.05 to 0.2. The weight ratio of more than 0.05 is required to at least improve the softening point of the glass sealant 9 on the one hand. The weight ratio of less than 0.2 is required to prevent the softening point from excessively risen, thus ensuring to positively vitrify the glass sealant 9 at an operating temperature on the other hand. The weight ratio of the silicate glass to the glass-based component may be within a range from 0.10 to 1.15 upon putting the glass sealant 9 into practical use.

In order to ensure the relationship of the above weight ratio, weight percentage of the granular aluminosilicate glass ranges from 40% to 50%, while weight percentage of the granular silicate glass ranging from 2.5% to 10%, weight percentage of the powdered metal ranging from 40% to 60%.

By changing addition of the silicate glass and an amount of combination of vitreous components $SiO_2$, $Al_2O_3$, CaO, MgO, BaO and $P_2O_5$ each based on the aluminosilicate glass, each softening point of prepared glass sealants is measured. As a result, softening points of more than 1000° C. is obtained as shown in Table 1.

TABLE 1

| | vitreous components (wt %) | | | | | | addition of silicate | softening |
|---|---|---|---|---|---|---|---|---|
| | $SiO_2$ | $Al_2O_3$ | CaO | MgO | BaO | $P_2O_5$ | glass (wt %) | point (°C.) |
| alumino-silicate glass (A) | 54 | 22.5 | 7 | 6.5 | 4 | 6 | 0 | 930 |
| | | | | | | | 5 | 1010 |
| | | | | | | | 10 | 1100 |
| | | | | | | | 15 | 1130 |
| alumino-silicate glass (B) | 56 | 20.5 | 8 | 7.5 | 4 | 4 | 0 | 970 |
| | | | | | | | 5 | 1030 |
| | | | | | | | 10 | 1150 |
| | | | | | | | 15 | 1190 |
| alumino-silicate glass (C) | 58 | 20.5 | 7.5 | 7 | 5 | 2 | 0 | 1010 |
| | | | | | | | 5 | 1080 |
| | | | | | | | 10 | 1250 |

TABLE 1-continued

| vitreous components (wt %) | | | | | | addition of silicate glass (wt %) | softening point (°C.) |
|---|---|---|---|---|---|---|---|
| $SiO_2$ | $Al_2O_3$ | CaO | MgO | BaO | $P_2O_5$ | | |
| | | | | | | 15 | 1280 |

Endurance test is carried out by preparing test pieces of glass sealant (A)~(J), and the test pieces (A)~(J) are tested for 100 hours by employing 2000 c.c., six-cylinder engine which is alternately operated at full throttle (for one minute) and idling to heat and cool each of the glass sealants in turn. As a result, it is found that the endurance of the test pieces of the glass sealants is significantly improved as shown in Table 2.

TABLE 2

| | alumino-silicate glass (a) wt % | silicate glass (b) wt % | powdered metal (c) · (Ni) wt % | (a) + (b) / (c) | (b) / (a) + (b) | softening point (°C.) | endurance test result: cracks an insulator | endurance test result: electrical conductivity |
|---|---|---|---|---|---|---|---|---|
| glass sealant A | 50 | 0 | 50 | 1.0 | 0 | 990 | non | no good |
| B | 48.5 | 1.5 | 50 | 1.0 | 0.03 | 1020 | non | no good |
| C | 47.5 | 2.5 | 50 | 1.0 | 0.05 | 1080 | non | good |
| D | 45.0 | 5.0 | 50 | 1.0 | 0.10 | 1260 | non | good |
| E | 42.5 | 7.5 | 50 | 1.0 | 0.15 | 1280 | non | good |
| F | 40.0 | 10.0 | 50 | 1.0 | 0.20 | 1300 | non | good |
| G | 37.5 | 12.5 | 50 | 1.0 | 0.25 | 1320 | non | no good |
| H | 40.0 | 2.5 | 57.5 | 0.74 | 0.06 | 1085 | occurred | no good |
| I | 45.0 | 2.5 | 52.5 | 0.91 | 0.05 | 1080 | non | no good |
| J | 55.0 | 4.0 | 41.0 | 1.44 | 0.07 | 1100 | non | no good |

Figure 5:
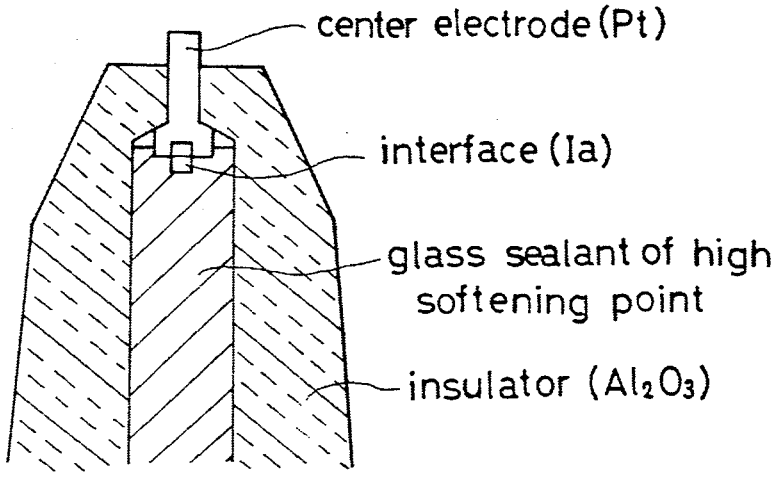
FIG. 5 shows a schematic view of a main part of the spark plug to show an interface (Ia) between a center electrode and a glass sealant.
Figure 6:
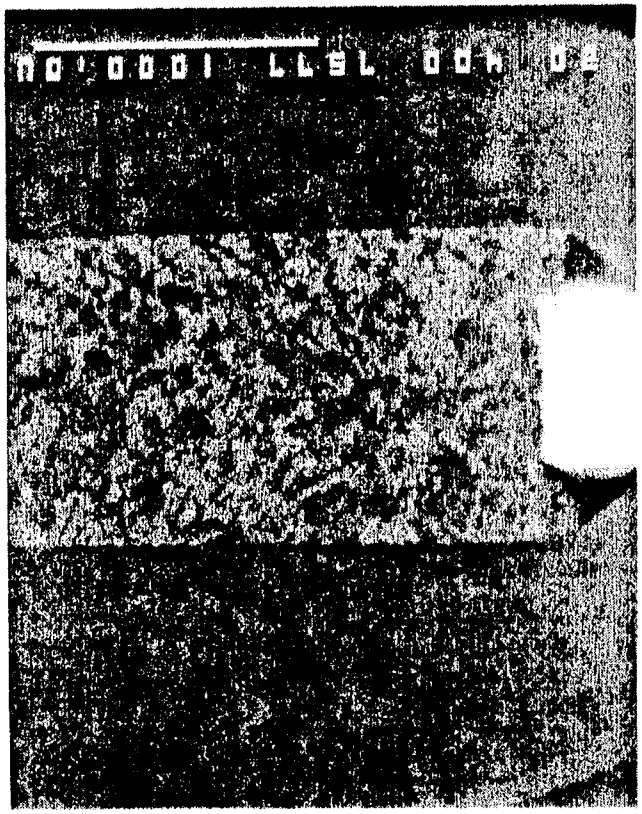
FIG. 6 is a structural view of FIG. 5 analyzed by means of EPMA (Electron Probe Micro Analyzer)
Figure 7A:
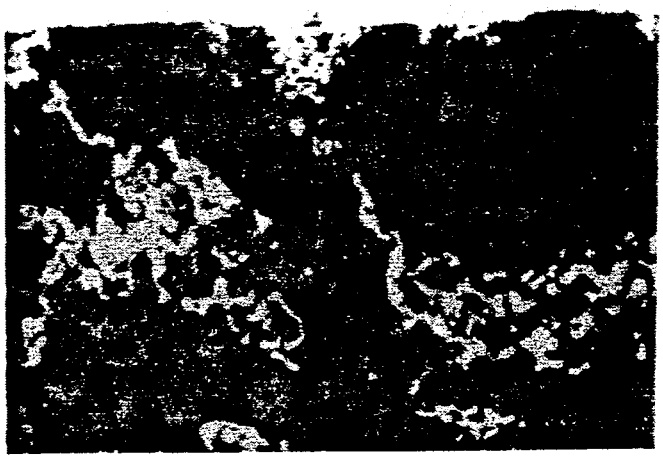
FIG. 7 shows magnified structural views of the interface (Ia), granular platinum (Pt), granular nickel (Ni), granular aluminium (Al), granular silicon (Si) and granular oxygen (O) each analyzed by means of EPMA.
Figure 7B:
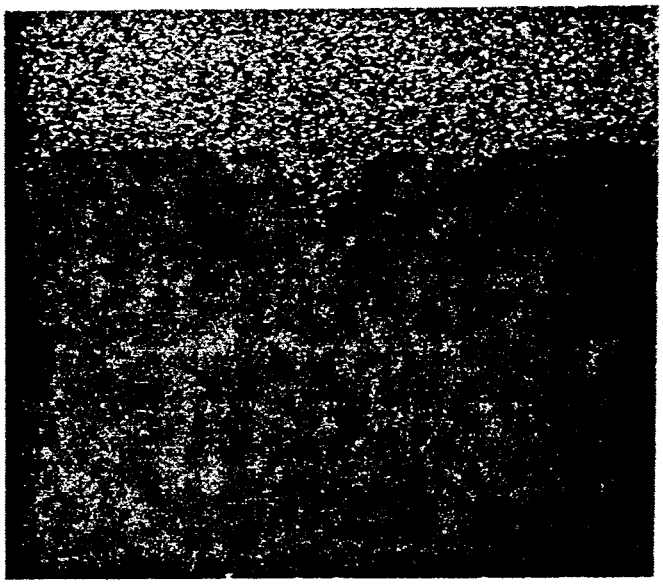
Figure 7C:
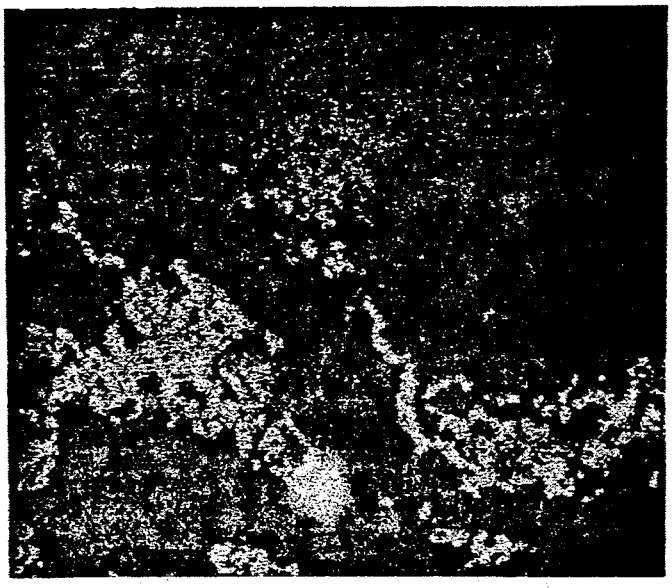
Figure 7D:
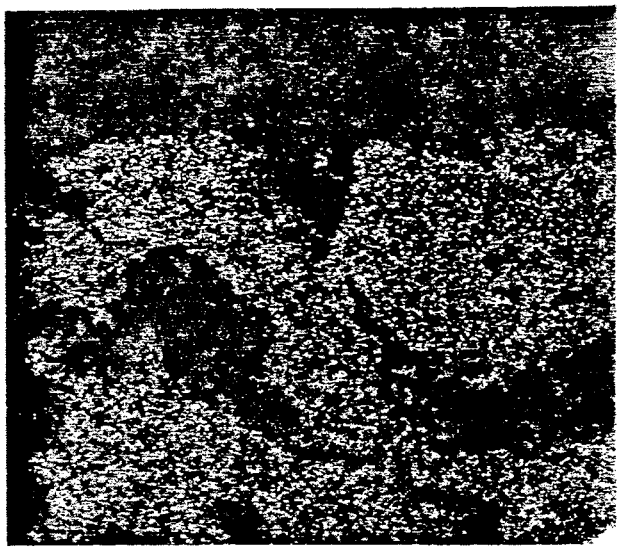
Figure 7E:
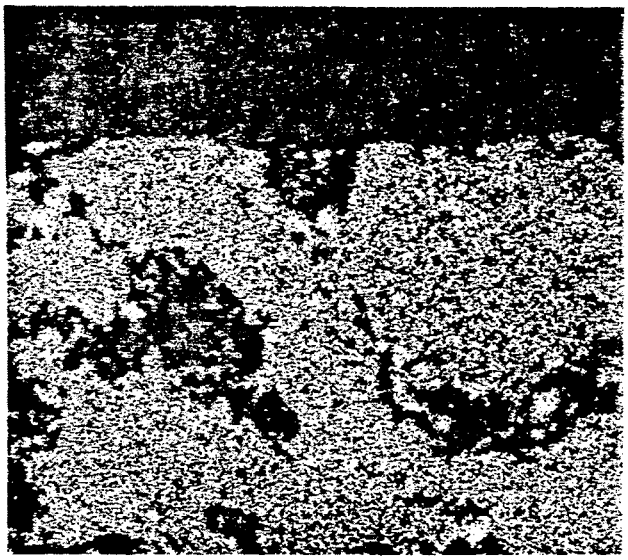
Figure 7F:
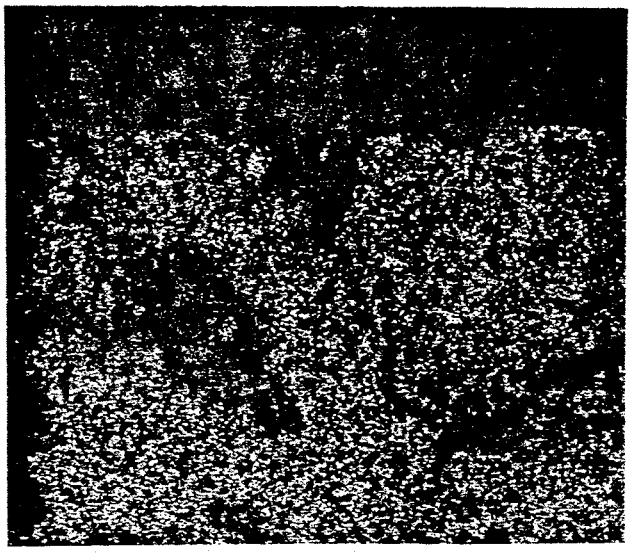

FIG. 5 shows a schematic view of a main part of the spark plug to cross-sectionally depict an interface (Ia) between a center electrode and a terminal electrode. FIG. 6 shows FIG. 5 analyzed by means of EPMA (Electron Probe Micro Analyzer). Further, FIG. 7 shows magnified structural views of the interface (Ia), granular platium (Pt), granular nickel (Ni) granular aluminum (Al), granular silicon (Si) and granular oxygen (O) each analyzed by means of EPMA.

As understood from the foregoing description, the invention enables the glass sealant to ensure an electrical conductivity between the center electrode and the terminal electrode, and improving to enhance softening point of the glass sealant. In addition, the invention enables to make a center electrode from corrosion-resistant precious metals and cermet, the latter of which is not bonded by means of welding.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A spark plug comprising:

a metallic shell in which a tubular ceramic insulator is placed;

a center electrode which is made of precious metals, and is supported at a front open end of the insulator simultaneously when the ceramic insulator is sintered, a front end of the center electrode opposing an outer electrode extended from the metallic shell to form a spark gap therebetween;

an electrically conductive glass sealant placed within the insulator to electrocally connect the center electrode to a terminal electrode which is provided in rear open end of the insulator;

the glass sealant being made from the following materials:

(a) granular aluminosilicate glass consisting of silica ($SiO_2$), alumina ($Al_2O_3$), alkali metal oxides and alkali earth metal oxides, granular size of the aluminosilicate glass being less than 250μ;

(b) granular silicate glass, granular size of which is less than 74μ; and (c) powdered metal, granular size of which is less than 74μ, the powdered metal being selected from the group consisting of nickel, chromium and nickel-chromium alloy.

2. A spark plug as recited in claim 1, wherein a relationship of weight ratio between (a), (b) and (c) is determined as follows:

$$0.8 \leqq [(a)+(b)]/(c) \leqq 1.2$$

and $$0.05 \leqq (b)/[(a)+(b)] \leqq 0.2.$$

3. A spark plug as recited in claim 1 wherein weight percentage of the granular aluminosilicate glass ranges from 40% to 50%, weight percentage of the granular silicate glass ranging from 2.5% to 10%, weight percentage of the powdered metal ranging from 40% to 60%.

4. A spark plug as recited in claim 1, wherein softening point of both the aluminosilicate glass and the silicate glass is more than 1000° C.

5. A spark plug as recited in claim 1, wherein the center electrode is an alloy in which yttrium oxide ($Y_2O_3$), zirconium oxide ($ZrO_2$) and thorium oxide ($ThO_2$) are dispersed in Platinum (Pt).

* * * * *